United States Patent [19]

Yatsko

[11] Patent Number: 4,775,058

[45] Date of Patent: Oct. 4, 1988

[54] DISPLAY SHELF ORGANIZER

[75] Inventor: John P. Yatsko, Alta Loma, Calif.

[73] Assignee: Jameson Pharmaceutical Corp., San Mateo, Calif.

[21] Appl. No.: 941,375

[22] Filed: Dec. 15, 1986

[51] Int. Cl.[4] ..... A47F 5/00

[52] U.S. Cl. ..... 211/184; 108/61; 40/650

[58] Field of Search ..... 211/184, 43; 108/60, 108/61; 40/16, 16.2, 16.4

[56] References Cited

U.S. PATENT DOCUMENTS 2,362,273 11/1944 Hopp ..... 40/16.2
2,895,241 7/1959 Ferdinand et al. ..... 40/16.2
4,453,324 6/1984 Greenberger ..... 40/16.2 X
4,488,653 12/1984 Belokin ..... 211/184
4,615,276 10/1986 Garabedian ..... 211/184 X

*Primary Examiner*—Robert W. Gibson, Jr.
*Attorney, Agent, or Firm*—Donald C. Feix; T. M. Freiburger

[57] ABSTRACT

A display shelf dividing and labeling assembly includes a plurality of divider strips which extend back to divide the display space on a shelf, connected to a front base member overhanging the front edge of the shelf. The divider strips are slidably received in the front base member to lock them in position. Labels may be inserted into the front base member, which may be retained on the shelf with adhesive pads.

4 Claims, 3 Drawing Sheets

DISPLAY SHELF ORGANIZER

BACKGROUND OF THE INVENTION

The invention relates to a display shelf organizer. More particularly, the invention relates to a simple and easy to use device for organizing and labeling items on display on a shelf.

The large number of consumers who daily examine and handle articles on retail display invariably results in items being misplaced and the display as a whole becoming generally disordered. Retailers must attempt to maintain an orderly arrangement of this multitude of variously sized and shaped articles being displayed. Time is consumed in rearranging articles back to their proper location.

Further, where items are displayed side by side, confusion of the consumer between similar items may result. The consumer may wrongfully select an item improperly placed.

Attempts have been made at remedying this problem by sectioning off specific areas of a shelf in different ways. These include use of baskets or cumbersome dividers which may significantly reduce the shelf space available for display. In addition, these methods often require special components and fixtures and/or articles on the shelves which complicate their usage and limit dividing capabilities to pre-set sizes and locations.

Therefore, it is among the objects of this invention to provide a simple, low-cost shelf divider and labeling unit offering greater flexibility in the positioning of dividers in order to accommodate the various sizes and shapes of items to be displayed, while reducing to a minimum the displacement of usable display space taken up by such a unit.

SUMMARY OF THE INVENTION

In accordance with the present invention, a display shelf organizer is formed by securing generally long, thin, parallel divider strips perpendicularly to a front base having a nameplate bearing member. The divider strips are secured in such a manner that the strips are slideable along the length of the nameplate member. The divider strips rest on a shelf to divide the space on the shelf, with the nameplate member hanging over the front edge of the shelf to display one or more labels.

The divider strips can be adjusted in position on the shelf so that the spacing between adjacent strips corresponds to an appropriate width for accommodating articles to be displayed.

The front nameplate bearing member rests against and overlaps the front edge of the shelf, providing a front planar surface at an appropriate viewing angle. A nameplate label or card may be inserted into the nameplate member to display information regarding the items on the shelf.

The nameplate member preferably has a front nameplate bearing surface with lipped flanges at its top and bottom edges, forming parallel upper and lower slots for slideably receiving a nameplate or nameplates.

The front base member, including the nameplate member, preferably is formed as one piece, and each divider strip is injection molded.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

DESCRIPTION OF THE DRAWINGS

FIG. 5 shows a shelf divider with a different number of divider strips and with different spacings of the divider strips as compared with that shown in FIG. 1.

DESCRIPTION OF PREFERRED EMBODIMENT

Figure 1:
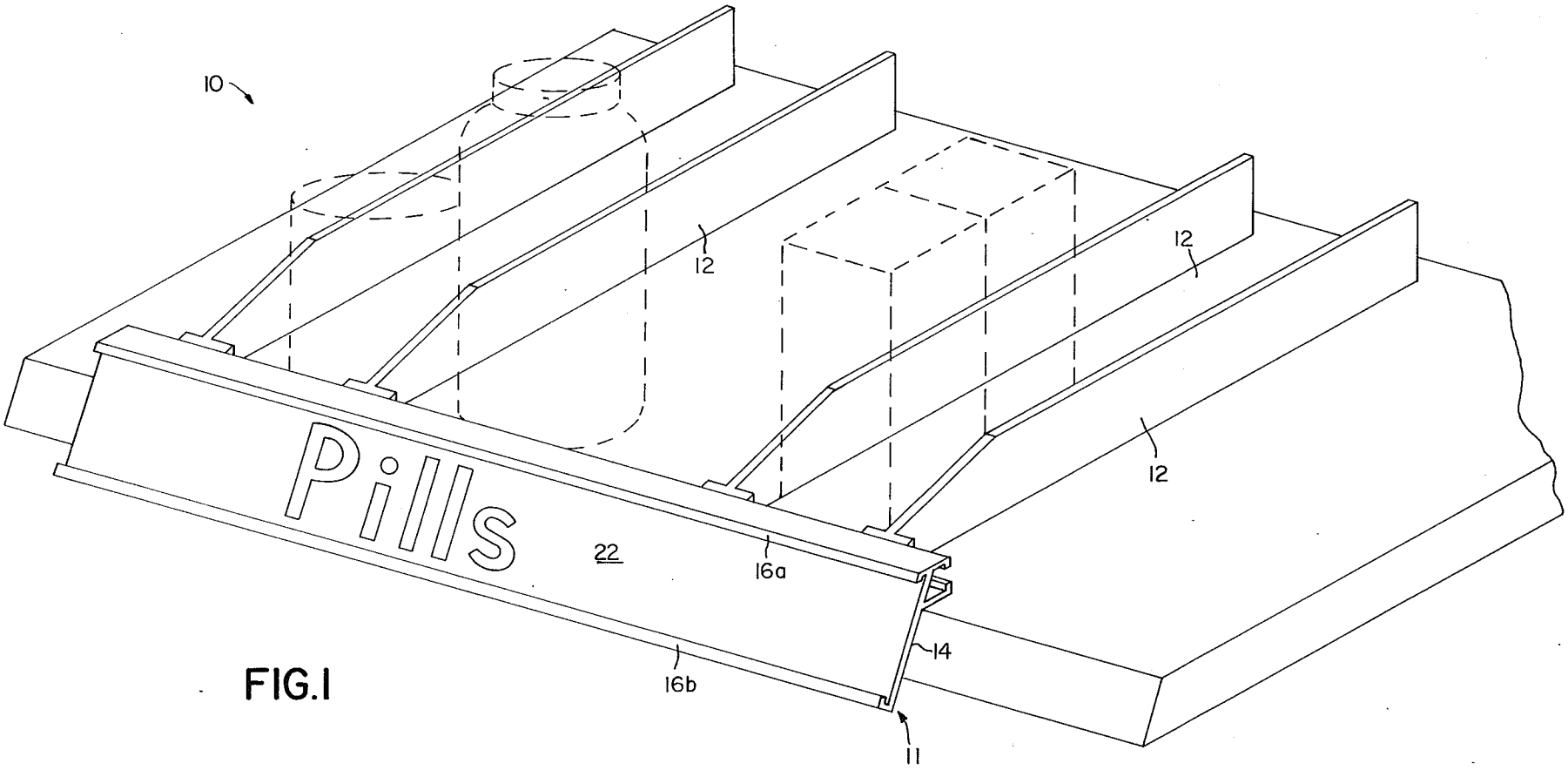
FIG. 1 is an isometric view showing a display shelf organizer or shelf divider constructed in accordance with one embodiment of the invention and installed on a shelf.

A preferred embodiment of a display shelf organizer in accordance with the present invention is shown in FIG. 1, generally indicated by the reference number 10.

The display shelf organizer 10 includes a front base member 11 to which a plurality of generally long thin divider strips 12 are slideably secured.

The divider strips 12 are arranged side by side in spaced parallel fashion so as to extend perpendicularly back from the front base member 11.

Figure 3:
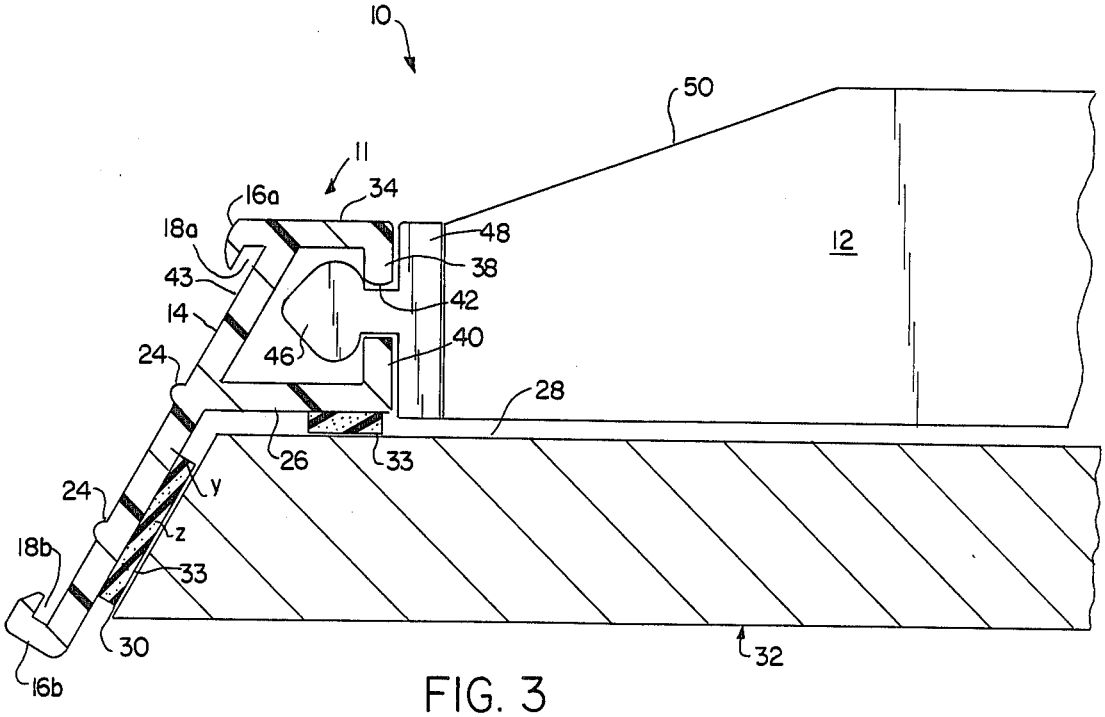
FIG. 3 is a side elevation view in section, taken generally alon the line and in the direction indicated by the arrows 3—3 in FIG. 2.

The front base member 11 in the preferred embodiment is constructed from plastic and comprises a nameplate bearing member 14 which runs the length of the front base member 11 and is of a generally flat shape and elongated in the horizontal direction. Both the top and bottom edges of the nameplate bearing member 14 have lipped flanges **16*a* and 16*b* which provide upper and lower slots 18*a* and 18*b*, respectively, as best seen in FIG. 3, to receive and hold a nameplate 22. The nameplate or label 22 may be changed to provide information concerning the items being displayed, simply by sliding the nameplate or label card in and out of the slots 18*a* and 18*b***.

Figure 2:
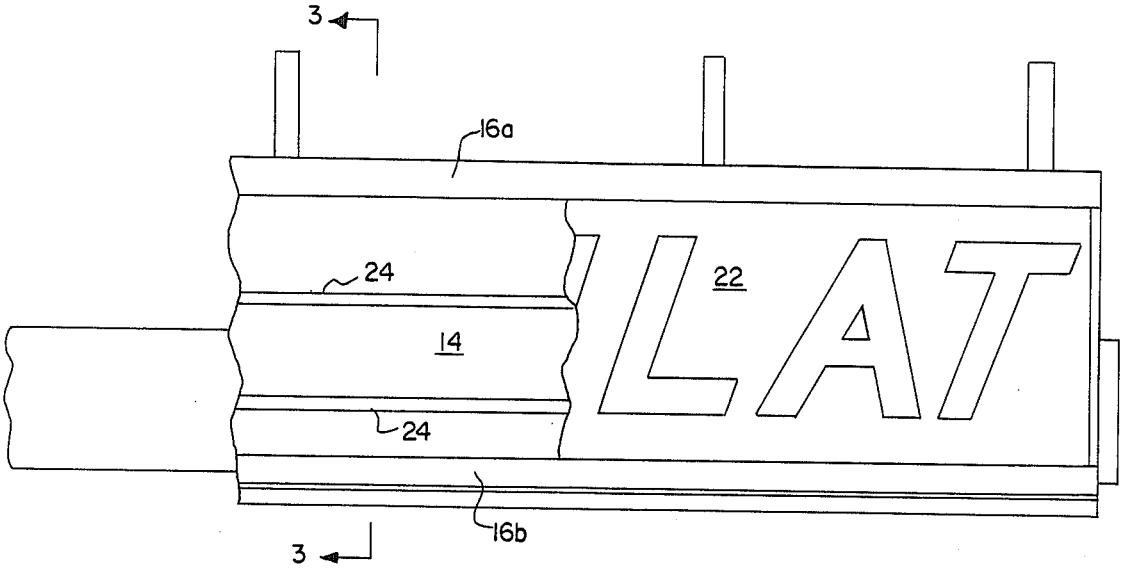
FIG. 2 is a front elevation view of the shelf divider of the invention.

On the front surface of the nameplate bearing member 14, as seen in FIGS. 2 and 3, are a plurality of ribs 24 which slightly offset the nameplate 22 from the surface of the nameplate bearing member 14 in order to securely retain the nameplate within the slots **18*a* and 18*b***.

A lower horizontal flange 26 is attached to, preferably integrally formed with the nameplate bearing member 14, extending rearwardly from the nameplate bearing member and running the full length longitudinally of the nameplate bearing member, as shown in FIGS. 1 and 3. The nameplate bearing member 14 is adjoined obliquely to the lower horizontal flange 26, so that the nameplate bearing member 14 is oriented in a position tilted back somewhat from vertical, preferably about 30 degrees. This angle of inclination may follow a similar angularity between the top and front surfaces 28 and 30 of the shelf 32 on which the divider assembly 10 is installed.

Adhesive pads 33 may be secured to the surfaces of the horizontal flange 26 and of the nameplate bearing number 14, as shown, to secure the front base member 11 to the shelf 32. These pads may be continuous throughout the length of the front base member 11, with adhesive on both sides of the pads and preferably including a release strip on the outer side of each pad, which is to be removed when the front base member is installed.

An upper horizontal flange 34 is in generally spaced parallel relation to the lower horizontal flange 26 and is also attached to or integrally formed with the nameplate bearing member 14, as best seen in FIG. 3. Gripping flanges 38 and 40, respectively, extend generally at right angles from the upper horizontal flange 34 and the lower horizontal flange 26, as shown in FIG. 3, to provide a relatively narrow gap or slot 42 between them at the rear of the front base member. The gripping flanges 38 and 40 extend toward one another, as shown in the drawing, and provide a means for engagement with the divider strips 12, as further explained below. An internal space or cavity 43 is formed by the nameplate bearing member 14 and the upper and lower horizontal flanges 34 and 26, as shown in FIGS. 1 and 3.

Figure 4:
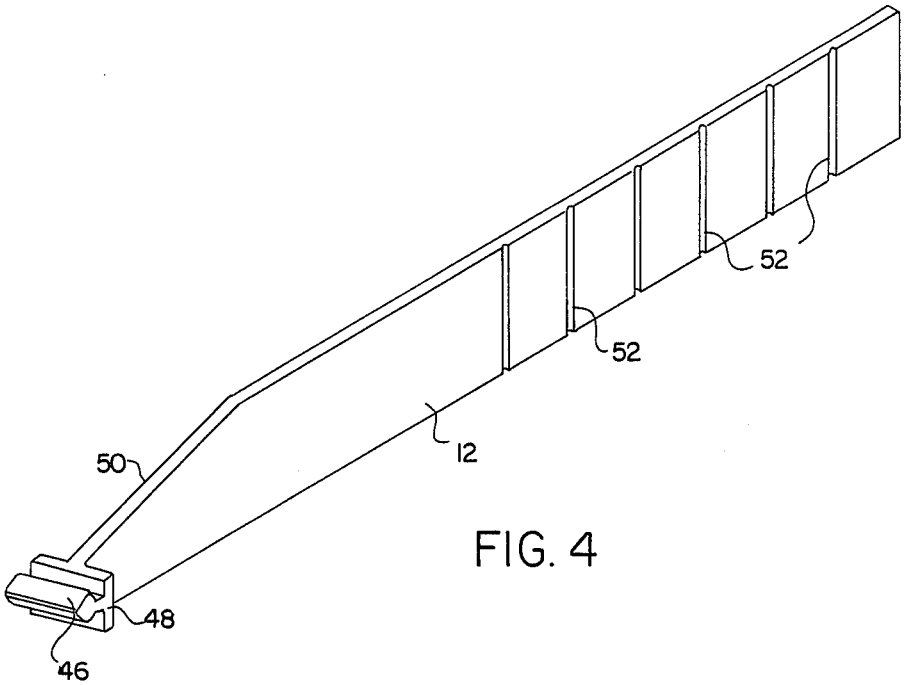
FIG. 4 is an isometric view of one of the divider strips used in the shelf divider shown in FIG. 1.
Figure 5:
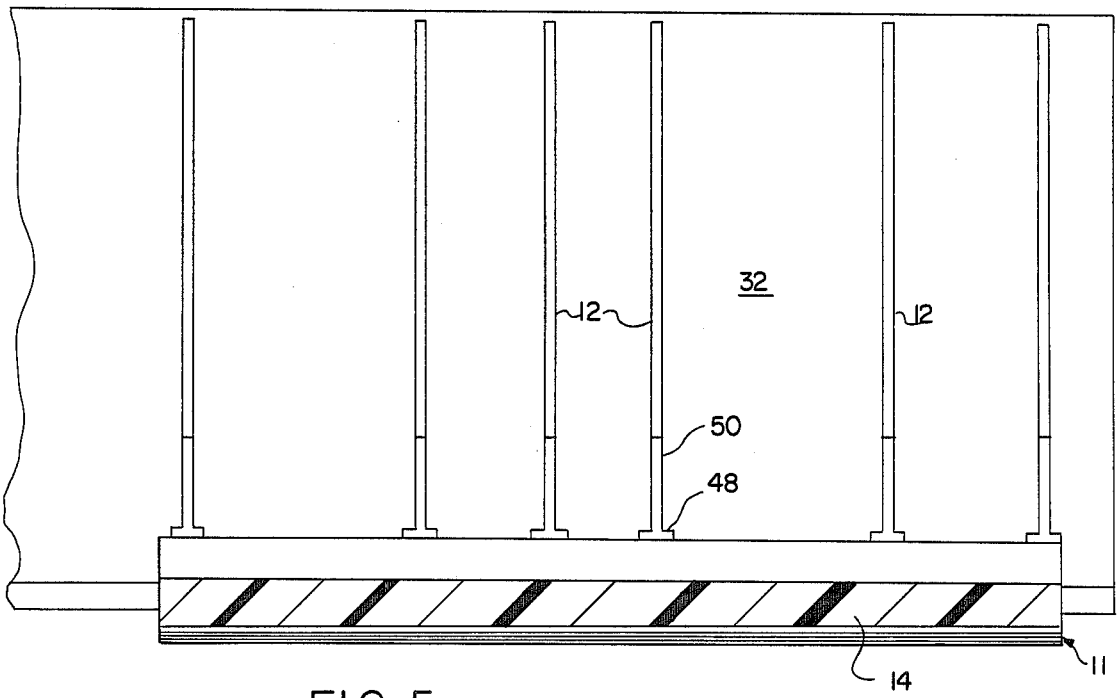
FIG. 5 is a top plan view of a shelf divider constructed and assembled in accordance with the present invention.

As shown in FIG. 3 and also in FIG. 4, each divider strip 12 has a front end including a locking tab 46 which is generally spade-shaped in cross-section with an enlarged head portion. The locking tab 46 is of a somewhat elongated shape as shown in FIG. 4, integrally molded with the divider strip 12 via an end flange member 48. The spade-shaped locking tab 46 extends perpendicular to the length of the divider strip 12, as shown.

The locking tab 46 and the adjacent flange member 8, on the one hand, and the gripping flanges 38 and 40 and the slot 42, on the other hand, cooperate to form a locking mechanism which secures each divider strip 12 to the front base member 11 and holds the divider strips 12 in the proper orientation while permitting deliberate sliding movement. As shown in FIG. 3 and also in FIG. 1, the spade-shaped locking tab 46 of each divider strip slides tightly into the gap or slot 42 of the front base member 11, with the end flange member 48 of the divider strip 12 abutting closely against the back sides of the gripping flanges 38 and 40 of the front base member 11.

The divider strips 12 are thus securely gripped by the front base member 11, but may be moved laterally with a small amount of force, for adjusting the respective positions of all the divider strips 12.

As shown in the drawings, the top of each divider strip, near the front, may have an angled or beveled portion 50, providing a transition between the height of the remainder of the divider strip and the height of the front base member 11.

As shown in FIG. 4, each divider strip 12 may include one or more lines of reduced thickness 52, transverse to the length at the divider strip, for making the divider strip easily breakable along that line to shorten the strip appropriately for the width of the shelf.

While I have illustrated and described the preferred embodiments of my invention, it is to be understood that these are capable of variation and modification, and I therefore do not wish to be limited to the precise details set forth, but desire to avail myself of such changes and alterations as fall within the purview of th following claims.

I claim:

1. A shelf divider and labeling assembly for use on a shelf on which items are displayed, comprising, a front base member which overhangs a front edge of the shelf, including means for holding and displaying at least one nameplate, a plurality of divider strips arranged in spaced parallel fashion so as to extend perpendicularly back from the base member, each divider strip being generally thin and flat and arranged to lie on the shelf surface with a bottom edge of the divider strip contacting the shelf surface and planes within which the divider strips lie being parallel to one another and perpendicular to the shelf surface, and wherein the divider strips each include at least one line of reduced thickness extending transversely across the divider strip, so that the divider strip is breakable along the line of reduced thickness in order to shorten the divider strip to accommodate shelves of different depths, and means for slideably attaching the divider strips to the front base member so as to allow the front base member to overhang the front edge of the shelf while the divider strips rest on the surface of the shelf, said means comprising, an elongated end flange member at a forward end of each divider strip, oriented transversely to the length of the divider strip, a locking tab extending forwardly from the end flange member, having an enlarged head portion, upper and lower generally horizontal flanges on the front base member, integrally formed with and extending back from the nameplate bearing member and substantially coextensive with the length of the front base member, with the upper and lower horizontal flanges being spaced apart vertically and each including a gripping flange extending from the rearward end of the horizontal flange and generally toward the opposite horizontal flange, defining an elongated gap or slot between the two gripping flanges, the gripping flanges being positioned so as to be contacted and engaged flatly at their back sides by the end flange members of the divider strips when the shelf divider is assembled, the end flange members having a height generally coextensive with the height defined by the horizontal flanges and gripping flanges, and the gap or slot, and the spacing between the upper and lower horizontal flanges, being such as to receive the locking tab of the divider strip slideably between the upper and lower horizontal flanges with the enlarged head portion received within a space defined by the nameplate bearing member and the upper and lower horizontal flanges, and with the rear surface of the gripping flanges closely abutting against the end flange member of the divider strips, and with upper and loer elongated horizontal recesses between the head portion and the end flange member of the divider strip closely receiving the upper and lower gripping flanges of the front base member such that any rotational movement of the divider strip with respect to the front base member is substantially prevented by the close engagement of the gripping flanges in the horizontal recesses in combination with the engagement of the end flange member with the back sides of the gripping flanges, whereby the divider strips are securely held and correctly oriented with respect to the front base member, while being slideable laterally along the length of the front base member to adjust the spacings of the divider strips on the shelf.

2. The apparatus of claim 1, including means for securing the front base member to the shelf, comprising adhesive pads positioned on rearward and bottom sides of the front base member so as to adhesively contact both the front edge of the shelf and the top surface of the shelf to securely retain the front base member in place on the shelf.

3. The apparatus of claim 1, wherein the means for holding a nameplate includes a nameplate bearing member of elongated and generally rectangular shape, and wherein the upper horizontal flange extends back directly from the top of the nameplate bearing member.

4. The apparatus of claim 1, wherein the locking tab of the divider strip is generally spade-shaped in cross section, with the spade turned horizontally and pointing toward the front base member.

* * * * *